US011156009B2

(12) United States Patent
MacKarvich

(10) Patent No.: US 11,156,009 B2
(45) Date of Patent: Oct. 26, 2021

(54) COMPRESSION POST WITH VISUAL INDICATION SYSTEM

(71) Applicant: Charles J. MacKarvich, Atlanta, GA (US)

(72) Inventor: Charles J. MacKarvich, Atlanta, GA (US)

( * ) Notice: Subject to any disclaimer, the term of this patent is extended or adjusted under 35 U.S.C. 154(b) by 72 days.

(21) Appl. No.: 16/510,499

(22) Filed: Jul. 12, 2019

(65) Prior Publication Data

US 2021/0010283 A1 Jan. 14, 2021

(51) Int. Cl.
*E04G 25/04* (2006.01)
*E04G 25/06* (2006.01)

(52) U.S. Cl.
CPC ..... *E04G 25/04* (2013.01); *E04G 25/06* (2013.01); *E04G 25/061* (2013.01); *E04G 25/065* (2013.01)

(58) Field of Classification Search
CPC ..... E04G 25/065; E04G 25/06; E04G 25/061; E04G 25/04; F16B 2/12
USPC .... 248/542, 161, 404, 405, 406.1, 407, 408, 248/410, 423, 351, 354.1, 354.3, 354.4, 248/354.5, 354.6, 200.1
See application file for complete search history.

(56) References Cited

U.S. PATENT DOCUMENTS 1,350,349 A 8/1920 Walther
2,090,550 A * 8/1937 Pilblad ..... H04R 1/08 248/410
2,192,079 A * 2/1940 Hinselmann ..... E21D 15/285 254/116
3,734,441 A * 5/1973 Lux ..... F16B 2/246 248/354.1
3,734,467 A * 5/1973 Weeden ..... E04H 17/163 256/65.04
3,856,421 A * 12/1974 Nogler ..... E04G 25/065 403/118
4,733,844 A * 3/1988 Molloy ..... E04F 21/1805 248/354.1
4,899,452 A * 2/1990 Schafer ..... G01C 15/06 33/296
4,928,916 A * 5/1990 Molloy ..... E04F 21/1805 248/354.1
5,186,429 A * 2/1993 Linnepe ..... B60S 9/04 248/354.1
5,317,813 A * 6/1994 Reed ..... G01B 3/08 33/348

(Continued)

OTHER PUBLICATIONS

MacKarvich, Charles J.; Applicant-Initiated Interview Summary for U.S. Appl. No. 17/016,586, filed Sep. 10, 2020, dated Mar. 2, 2021, 4 pgs.

(Continued)

*Primary Examiner* — Christopher Garft
*Assistant Examiner* — Michael McDuffie
(74) *Attorney, Agent, or Firm* — Taylor English Duma LLP

(57) ABSTRACT

Example aspects of an indicator for a compression post, a compression post for a building, and a method for using a compression post are disclosed. The indicator for a compression post can comprise a leg configured to engage a support plate of the compression post; and an indication portion supported by the leg and comprising; a first visual indicator configured to indicate that the compression post is in an uncompressed configuration; and a second visual indicator configured to indicate that the compression post is in a compressed configuration.

16 Claims, 3 Drawing Sheets

(56) References Cited

U.S. PATENT DOCUMENTS 5,651,535 A 7/1997 David
5,913,783 A * 6/1999 Weener ..... A47B 96/1425 248/354.1
6,152,434 A * 11/2000 Gluck ..... E04F 21/1805 254/114
6,247,882 B1 * 6/2001 Huang ..... B60P 7/15 410/143
6,254,161 B1 7/2001 Wochaski
6,267,347 B1 7/2001 Ryan et al.
6,347,777 B1 * 2/2002 Webber ..... A47C 7/402 248/188.5
7,086,631 B2 * 8/2006 Lee ..... F16M 11/26 248/161
7,290,742 B2 * 11/2007 Wang ..... A45B 7/005 135/16
7,510,152 B2 3/2009 Melic
7,895,803 B2 3/2011 Downey et al.
8,002,229 B2 * 8/2011 Hewson ..... E04G 21/3233 248/410
8,146,876 B1 * 4/2012 Young ..... F16M 11/28 248/412
8,152,118 B2 4/2012 Melic
8,490,930 B2 * 7/2013 Huang ..... B60P 7/15 248/125.2
8,496,217 B2 * 7/2013 Cerezo Lotina ..... B60P 7/15 248/354.1
8,806,952 B1 * 8/2014 Glass ..... A63B 61/02 73/826
9,663,962 B1 * 5/2017 Whittemore ..... E04G 25/065
10,774,552 B2 * 9/2020 Klein ..... E04F 21/1833
10,844,607 B2 11/2020 Potter
11,098,493 B2 8/2021 Mackarvich
2010/0140436 A1 * 6/2010 Wu ..... A47C 7/54 248/354.4
2010/0141464 A1 * 6/2010 Robertson, Jr. .... G08B 13/1436 340/686.1
2010/0308196 A1 * 12/2010 Lee ..... D06F 53/04 248/353
2011/0097180 A1 * 4/2011 Bastone ..... E04G 25/04 414/10
2012/0096938 A1 * 4/2012 Edwards ..... G01F 23/165 73/290 R
2016/0069367 A1 3/2016 Christensen
2021/0010284 A1 1/2021 MacKarvich

OTHER PUBLICATIONS

MacKarvich, Charles J.; Non-Final Office Action for U.S. Appl. No. 17/016,586, filed Sep. 10, 2020, dated Dec. 22, 2020, 15 pgs.
Mackarvich, Charles J.; Notice of Allowance for U.S. Appl. No. 17/016,586, filed Sep. 10, 2020, dated Jan. 20, 2021, 13 pgs.
Mackarvich, Charles J.; Corrected Notice of Allowance for U.S. Appl. No. 17/016,586, filed Sep. 10, 2020, dated Jul. 26, 2021, 6 pgs.

* cited by examiner

COMPRESSION POST WITH VISUAL INDICATION SYSTEM

TECHNICAL FIELD

This disclosure relates to building construction. More specifically, this disclosure relates to a compression post comprising a visual indication system.

BACKGROUND

Compression posts are commonly used in building construction and can provide support for ceilings and/or elevated floors during construction, such as before proper support structures are built in place. Typically, a compression post extends between the floor and the ceiling of a single level of a building and can be compressed therebetween to hold the compression post in place, which prevents the compression post from being moved out of place by accidental contact with a worker or construction equipment, shifting of the building during construction, or even seismic events. Compression posts must be properly compressed to provide the necessary structural support; however, typical compression posts do not indicate to a user/installer whether the compression post is properly or improperly compressed. When the compression post is not properly compressed, it can be moved out of place. For example, a construction worker can accidentally run into the compression post, knocking the compression post out of position and potentially destabilizing the building, even causing the collapse of a portion or all of the building.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts off the disclosure as an introduction to the following complete and extensive detailed description.

Disclosed is an indicator for a compression post comprising a leg configured to engage a support plate of the compression post; and an indication portion supported by the leg and comprising; a first visual indicator configured to indicate that the compression post is in an uncompressed configuration; and a second visual indicator configured to indicate that the compression post is in a compressed configuration.

Also disclosed is a compression post for a building comprising a post outer shell defining a hollow interior and comprising a first section and a second section; an inner post slidably engaged with at least the second section of the post outer shell; and a visual indication system configured to indicate when the compression post is in a compressed configuration and an uncompressed configuration.

Also disclosed is a method for using a compression post, the method comprising providing a post outer shell and an inner post, the post outer shell comprising a first section and a second section, the inner post slidably engaged with at least the second section, wherein the compression post is in an uncompressed configuration; showing a first visual indicator of a visual indication system in the uncompressed configuration; moving the second section away from the first section to slide the second section along the inner post and to compress a spring and placing the compression post in a compressed configuration; and revealing a second visual indicator of the visual indication system in the compressed configuration.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
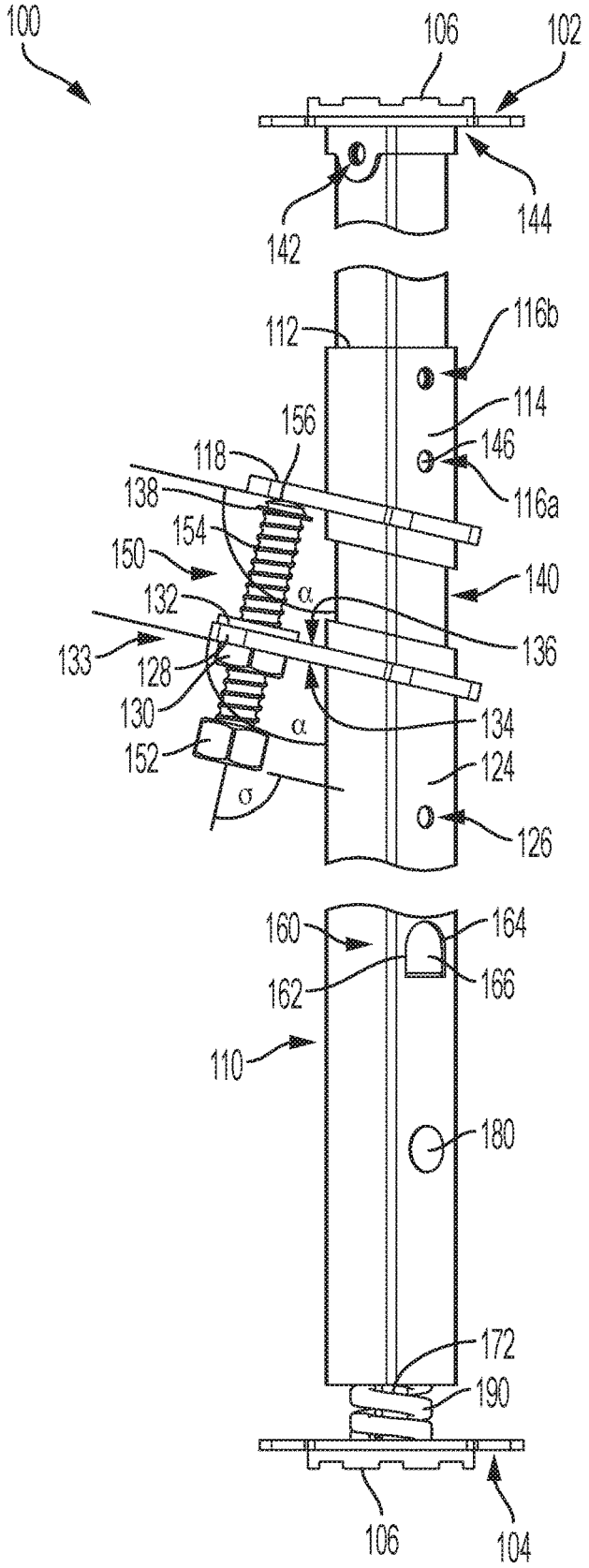
FIG. 1 is a front view of a compression post comprising an indicator, in accordance with one aspect of the present disclosure, wherein the compression post is in an uncompressed configuration.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed in the present application is a compression post and associated methods, systems, devices, and various apparatus. Example aspects of the compression post can comprise a post outer shell and an inner post slidably received within at least a portion of the post outer shell. The compression post can further comprise a visual indication system for indicating when the compression post is properly compressed. It would be understood by one of skill in the art that the disclosed compression post is described in but a few exemplary aspects among many. No particular terminology or description should be considered limiting on the disclosure or the scope of any claims issuing therefrom.

FIG. 1 illustrates a first aspect of a compression post 100 according to the present disclosure. The compression post 100 can be positioned to extend between a ceiling and a floor of a building (not shown). As illustrated, the compression post 100 can comprise two support plates: a top plate 102 for engaging the ceiling and a bottom plate 104 for engaging the floor. The compression post 100 can also comprise a post outer shell 110 and an inner post 140, which together can extend between the top plate 102 and the bottom plate 104. In some aspects, each of the top plate 102 and bottom plate 104 can comprise a gripping pad 106 for improved grip strength with the ceiling and floor, respectively. The gripping pad 106 can be formed from a non-slip material, such as, for example, rubber. Example aspects of the post outer shell 110 can be substantially rectangular in shape and can define a hollow interior. The inner post 140 can also be substantially rectangular in shape and can be received within the hollow interior of the post outer shell 110. Each of the inner post 140 and post outer shell 110 can define a substantially square cross-sectional shape. However, in other aspects, the inner post 140 and post outer shell 110 can define any other suitable shape, such as cylindrical, and any other suitable cross-sectional shape, such as circular. Furthermore, example aspects of the inner post 140 and post outer shell 110 can be formed from a metal material, such as, for example, steel. In other aspects, the inner post 140 and post outer shell 110 can be formed from another metal material, such as aluminum, iron, a plastic material, or any other suitable material known in the art.

As shown, in example aspects, the inner post 140 can extend beyond a top end 112 of the post outer shell 110 and can engage the top plate 102. In some aspects, the inner post 140 can comprise a foot 142 at a top end 144 thereof, and the foot 142 can be pivotably coupled to the top plate 102. The pivotable connection between the foot 142 of the inner post 140 and the top plate 102 can accommodate for slight vertical misalignment of the compression post 100 or for non-parallel floors and ceilings, if present. Further, according to example aspects, the inner post 140 can be configured to slide within the post outer shell 110, or portions thereof. According to example aspects, the post outer shell 110 can define a first section, such as an upper section 114, and a second section, such as a lower section 124, that can be spaced from the upper section 114. The inner post 140 can extend through both of the upper and lower sections 114, 124, as shown. According to example aspects, the upper section 114 of the post outer shell 110 can define one or more upper holes 116 defined therethrough on both sides of the upper section 114. The lower section 124 of the post can also define one or more lower holes 126 defined therethrough on both sides of the lower section 124. In the present aspect, the upper and lower holes 116,126 can be spaced vertically along the upper section 114 and lower section 124, relative to the orientation shown.

In example aspects, a first bolt (not shown) can extend through one of the upper holes 116 and through a corresponding hole 146 through the inner post 140 to hold the upper section 114 in place relative to the inner post 140. In some aspects, multiple holes 146 can be defined through the inner post 140 to allow for the height of the compression post 100 to be adjusted. Specifically, the position of the inner post 140 relative to the upper section 114 can be selectively adjusted and the length of the compression post 100 can be selectively adjusted to accommodate varying distances between the floor and ceiling.

Similarly, a second bolt (not shown) can optionally extend through one of the lower holes 126 and can serve as a stop against a lower end (not shown) of the inner post 140. In some aspects, the first bolt or the second bolt can extend through one of the lower holes 126 and through another hole 146 in the inner post 140 in order to hold the lower section 114 in place relative to the inner post 140, such as for transportation of the compression post when not in use. Nuts can hold each of the bolts in place on the upper section 114 and the lower section 124, respectively. In some aspects, the bolts can be replaced with any other suitable device, such as a cotter pin, clevis pin, hitch pin, or a spring-loaded button mounted inside the inner post 140.

In example aspects, the upper section 114 can define an upper fastener ledge 118 extending therefrom and the lower section 124 can define a lower fastener ledge 128 extending therefrom. In some aspects, each of the upper and lower fastener ledges 118,128 can each be oriented at an obtuse angle α with respect to the post outer shell 110 and to a vertical direction. As such, the upper and lower fastener ledges 118,128 can be substantially parallel to one another. A fastener, such as a threaded bolt 150, as shown, can engage each of the upper fastener ledge 118 and lower fastener ledge 128. The threaded bolt 150 can define a bolt head 152 and a threaded tail 154 extending therefrom. In example aspects, the threaded tail 154 of the threaded bolt 150 can extend through an opening (not shown) in the lower fastener ledge 128 and a distal end 156 of the threaded tail 154 can abut the upper fastener ledge 118 distal from the bolt head 152. In the present aspect, a nut 130 and a washer 132 can be affixed to the lower fastener ledge 128, as shown, for example, by welding. The nut 130 and washer 132 be aligned with the opening, such that the nut 130, the opening, and the washer 132 can define an engagement assembly 133 through which the threaded tail 154 of the threaded bolt 150 can extend. In other aspects, the nut 130 and washer 132 can be affixed to the lower fastener ledge 128 by an adhesive or any other suitable fastener known in the art. According to example aspects, as shown, the nut 130 can be affixed to a lower surface 134 of the lower fastener ledge 128 and the washer 132 can be affixed to an upper surface 136 of the lower fastener ledge 128. Example aspects of the nut 130 can comprise threading configured to mate with the threading of the threaded bolt 150. Furthermore, as shown, example aspects of the threaded bolt 150 can comprise a snap ring 138 coupled thereto proximate the distal end 156 thereof, which can prevent the threaded bolt 150 from disengaging the engagement assembly 133, as described in further detail below.

The threaded bolt 150 can be loosened or tightened within the threaded nut 130 to move the upper section 114 and lower section 124 away from or towards one another, respectively. For example, when the threaded bolt 150 is tightened in the threaded nut 130, the distal end 156 of the threaded tail 154 can be pressed against the upper fastener ledge 118 to move the lower section 124 away from the upper section 114. On the other hand, when the threaded bolt 150 is loosened in the threaded nut 130, the threaded bolt 150 can move away from the upper fastener ledge 118, reducing the force applied to the spring 190 and allowing the spring 190 to bias the lower section 124 towards the upper section 114. According to example aspects, the snap ring 138 of the threaded bolt 150 can abut the washer 132 when the threaded bolt 150 is significantly loosened in order to prevent the threaded bolt 150 from disengaging the engagement assembly 133. The upper and lower fastener ledges 118,128 are oriented at the angle α, as described above, and the threaded bolt 150 extends orthogonal to the ledges 118,128, which can cause the upper section 114 and lower section 124 to push laterally in opposite directions against the inner post 140 as the threaded bolt 150 is tightened and the upper and lower section 124 are pushed apart. These lateral forces increase friction forces between the sections 114,124 and the inner post 140 to further hold the inner post 140 in place relative to the post outer shell 110.

Figure 2:
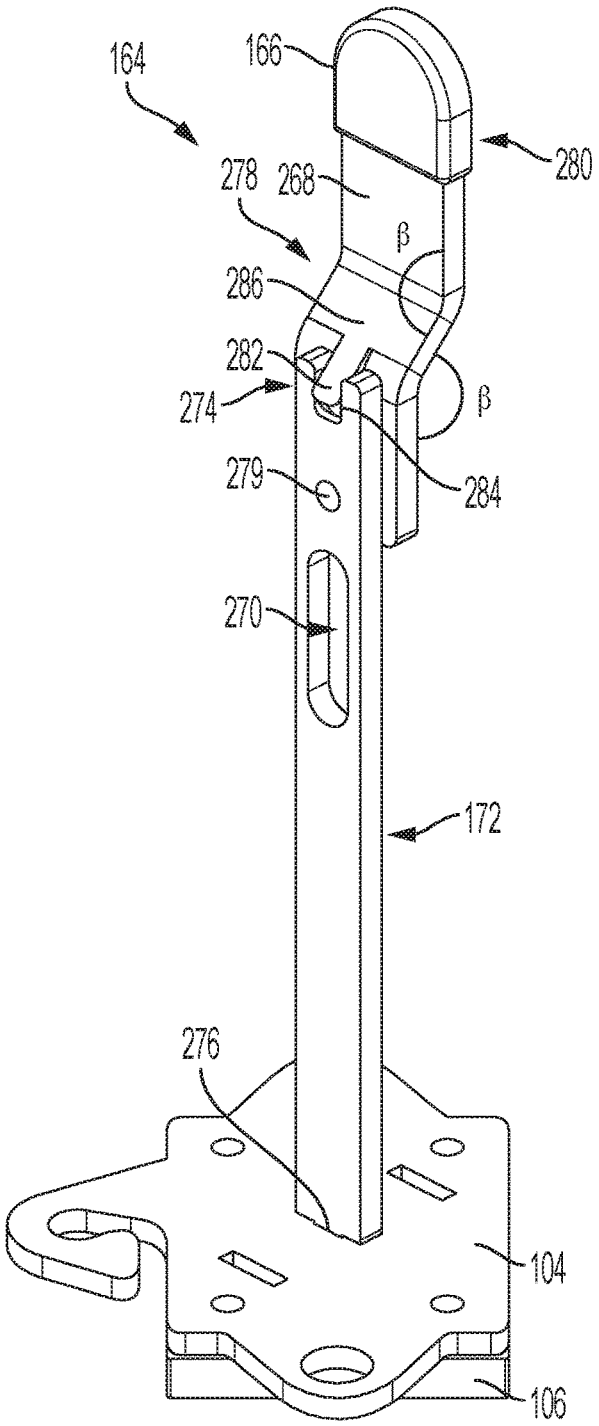
FIG. 2 is a front view of an indicator of FIG. 1.
Figure 3:
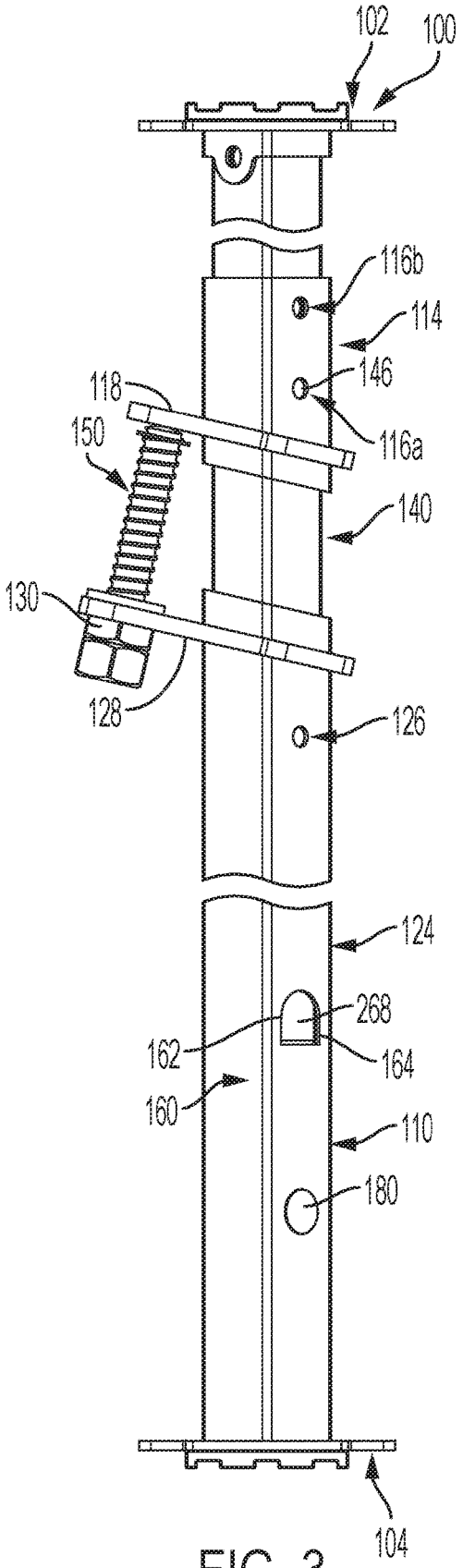
FIG. 3 is a front view of the compression post of FIG. 1 in a compressed configuration.

According to example aspects, the compression post 100 can be oriented in an uncompressed configuration, as shown in FIG. 1, and a compressed configuration, as shown in FIG. 3. Referring to FIG. 1, the compression post 100 can comprise a visual indication system 160 configured to indicate when the compression post 100 is fully in the compressed configuration. Example aspects of the visual indication system 160 can comprise a window 162 defined in the lower section 124 of the post outer shell 110 and an indicator 164 positioned within the hollow interior of the lower section 124 of the post outer shell 110 adjacent to the window 162. In one aspect, in the uncompressed configuration, a first visual indicator 166 of the indicator 164 can be visible through the window 162, and in the compressed configuration, a second visual indicator 268 (shown in FIG. 2) of the indicator 164 can be visible through the window 162. For example, in one particular aspect, the first visual indicator 166 can be a first color, such as red, and the second visual indicator 268 can be a second color, such as white, or can match the color of the post outer shell 110. In some aspects, the second visual indicator 268 can simply be a portion of the indicator 164 that is not the first visual indicator 166 and simply blends with the rest of the compression post 100. The visual appearance of the first visual indicator 166 can indicate that the compression post 100 is not fully compressed, while the visual appearance of the second visual indicator 268 can indicate that the compression post 100 is fully and properly compressed in the compressed configuration. In another aspect, the indicator 164 can include any suitable words, indicia, or any other markings to indicate that the compression post 100 is in either the compressed configuration or uncompressed configuration. Furthermore, in some other aspects, the indicator 164 can define additional visual indicators. For example, in one aspect, a third visual indicator (not shown) can be provided to indicate that the compression post is in a partially compressed configuration, in between the uncompressed configuration and the compressed configuration.

Example aspects of the compression post 100 can comprise a fastener, such as a bolt 180, for movably coupling the post outer shell 110 to the indicator 164 of the visual indication system 160. The bolt 180 can be fixedly secured to the post outer shell 110 through a hole (not shown) defined through the post outer shell 110. Example aspects of the bolt 180 can be slidably received within a slot 270 (shown in FIG. 2) of the indicator 164, such that the post outer shell 110 can slide relative to the indicator 164. According to example aspects, the inner post 140 can be configured to terminate within the lower section 124 at a location above the visual indication system 160, such that the inner post 140 does not interfere with the visual indication system 160. Furthermore, in example aspects, as shown, a spring 190 can extend between the bottom plate 104 of the compression post 100 and the bolt 180. The spring 190 can be a compression spring, for example, and can define a spring force. However, in other aspects, the spring 190 can be another type of spring. The spring 190 can wrap around a leg 172 of the indicator 164 as shown, and can extend between the bottom plate 104 and the bolt 180 received through the slot 270. In the uncompressed configuration of the compression post 100, as shown in FIG. 1, the spring force of the spring 190 can bias the bolt 180 upward within the slot 270 and away from the bottom plate 104. Because the bolt 180 can be fixedly secured to the post outer shell 110, the post outer shell 110 can consequently also be biased upward and away from the bottom plate 104. As such, the spring 190 can bias the compression post 100 to the uncompressed configuration.

Referring to FIG. 2, an example aspect of the indicator 164 is shown. Example aspects of the indicator can comprise a leg 172. The leg 172 can generally define an upper end 274 and a lower end 276, as shown. The lower end 276 of the leg 172 can be connected to or mounted on the bottom plate 104 of the compression post 100 (shown in FIG. 1). The leg 172 can extend generally upward from the bottom plate 104, relative to the orientation shown. According to example aspects, the slot 270 of the indicator 164 can be defined in the leg 172. In some aspects, the slot 270 can be oriented proximate the upper end of the leg 172, as shown; however, in other aspects, the slot 270 can be oriented at any other suitable location along the leg 172. Example aspects of the indicator 164 can further comprise an indicator bracket 277. The indicator bracket 277 can generally define a central portion 278 coupled to and extending generally upward from the upper end 274 of the leg 172, relative to the orientation shown, and an indication portion 280 distal from the leg 172. In the present aspect, the central portion 278 and the indication portion 280 can be monolithically formed; however, in other aspects, the central portion 278 and indication 280 can be separately formed and coupled together. According to example aspects, the central portion 278 can be attached to the leg 172 by a fastener 279, such as, for example, a bolt or screw. In some aspects, as shown, the central portion 278 can also comprise an arm 282 extending therefrom and configured to engage a notch 284 defined in the upper end 274 of the leg 172.

The indication portion 280 can comprise the first visual indicator 166 and the second visual indicator 268. In the present aspect, the second visual indicator 268, which, when visible through the window 162 can be indicative that the compression post 100 is in the compressed configuration, can be located on the indication portion 280 proximate to the central portion 278 of the indicator bracket 277. The first visual indicator 166, which, when visible through the window 162 can be indicative that the compression post 100 is not in compressed configuration, can be located on the indication portion 280 adjacent to the second visual indicator 168 and distal to the central portion 278. In some aspects, the indication portion 280 can be substantially parallel with the leg 172. Furthermore, as shown, some example aspects of the central portion 278 can define a bend 286. The bend 286 can extend between the leg 172 and the indication portion 280 at an angle β relative to each of the leg 172 and indication portion 280. As such, the indication portion 280 and the leg 172, while parallel to one another, can be vertically misaligned, relative to the orientation shown, which can push the indication portion 280 towards or against the window 162.

As described above, the spring force of the spring 190 (shown in FIG. 1) can bias the compression post 100 to the uncompressed configuration. Referring to FIG. 3, in the compressed configuration, the spring force can be overcome and the spring 190 (shown in FIG. 1) can be compressed. To move the compression post 100 from the uncompressed configuration to the compressed configuration, a force exceeding the spring force of the spring 190 must be applied to the spring 190. In the present aspect, to apply a force to the spring 190, the threaded bolt 150 of the compression post 100 can be rotated, such as with a drill or socket wrench, to push the threaded bolt 150 against the upper fastener ledge 118 and to move the lower section 124 of the post outer shell 110 away from the upper section 114 of the post outer shell 110. The lower section 124 of the post outer shell 110 can slide downward along the inner post 140, relative to the orientation shown. The first bolt can be engaged with one of the upper holes 116*a,b* of the upper section 114 and one of the holes 146 defined through the inner post 140, such that the inner post 140 can be fixed relative to the upper section 114 of the post outer shell 110. Thus, because the inner post 140 can be fixedly attached to the top plate 102 of the compression post 100, the inner post 140 and the upper section 114 of the post outer shell 110 can remain stationary as the lower section 124 moves downward, relative to the orientation shown, and away from the upper section 114.

As the lower section 124 moves away from the upper section 114, the lower section 124 can be moving towards the bottom plate 104 of the compression post 100. As such, the bolt 180 fixedly attached to the lower section 124 can slide downward, relative to the orientation shown, within the slot 270 (shown in FIG. 2) of the indicator 164 and can move towards the bottom plate 104. The spring 190 (shown in FIG. 1) can be sandwiched between the bolt 180 and the bottom plate 104, such that the spring 190 can be compressed as the bolt 180 moves towards the bottom plate 104. Furthermore, as the lower section 124 of the post outer shell 110 moves downward relative to the indicator 164, which can be fixedly connected to the bottom plate 104 by the leg 172 (shown in FIG. 1) of the indicator 164, the window 162 of the lower section 124 can also travel downward relative to the indicator 164. As such, the window 162 can move past the first visual indicator 166, which can be seen through the window 162 in the uncompressed configuration, and can move towards the second visual indicator 268. The threaded bolt 150 can be rotated to compress the spring 190 until the first visual indicator 166 is no longer visible and only the second visual indicator 268 is visible through the window 162, which can indicate that the compression post 100 is fully and properly compressed in the compressed configuration. For example, in one aspect, the compression force can be about 200 psi in the compressed configuration; however, in other aspects, the compression force can be any other suitable amount to properly compress the compression post 100 in the compressed configuration. Furthermore, as the spring 190 is compressed, the spring force of the spring 190 can resist the compression and can attempt to expand, applying a generally downward force against the bottom plate 104, relative to the orientation shown, and applying a generally upward force against the bolt 180, relative to the orientation shown, which can be transmitted to the top plate 102. As such, the compression post 100 can apply a force to both the floor and the ceiling of the building, fixing the compression post 100 in place to resist forces acting against it. It should be noted that, in other aspects of the compression post 100, the visual indication system 160 can be located at the upper section 114 of the compression post 100, as opposed the lower section 124. For example, the window 162 can be defined in the upper section 114 and the indicator 164 can be coupled to the top plate 102.

Figure 4:
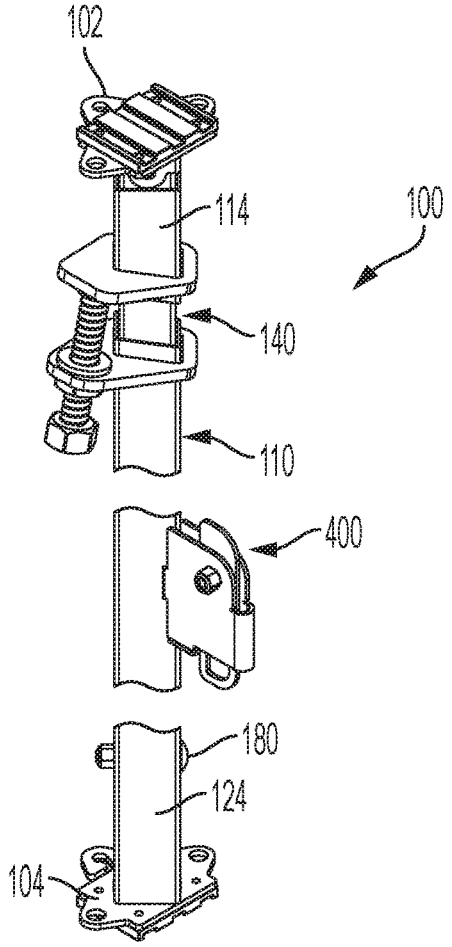
FIG. 4 is a top perspective view of the compression post of FIG. 1 in the compressed configuration.

Referring to FIG. 4, in some aspects, the compression post 100 can further comprise a bracket 400 coupled to the lower section 124 of the post outer shell 110. As shown, the bracket 400 can be coupled to the lower section 124 at a position above the window 162 (shown in FIG. 1). According to example aspects, the bracket 400 can be configured to engage a panel (not shown), such as, for example, a wire panel. The panel can be configured to support personnel (e.g., construction workers) above the floor of the building. In other aspects, the compression post 100 can include additional brackets 400 for supporting additional panels and/or the bracket 400 can be positioned at any other suitable location along the compression post 100.

Figure 5:
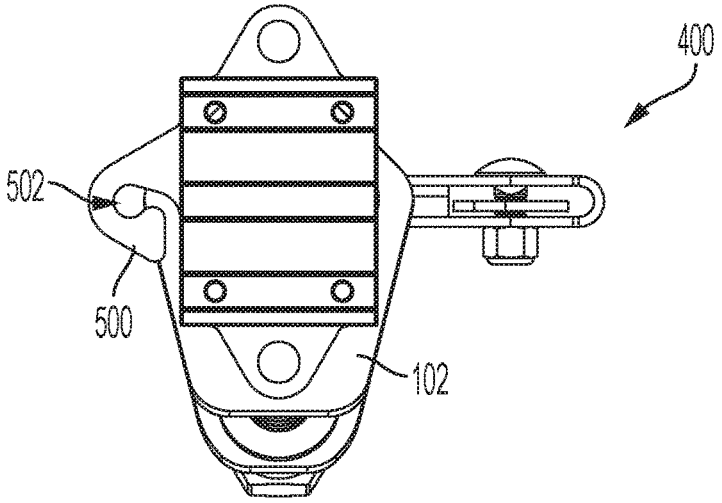
FIG. 5 is a top view of a top plate of the compression post of FIG. 1.

FIG. 5 illustrates a top view of the top plate 102. Example aspects of the top plate 102 can comprise a netting hook 500, as shown. The netting hook 500 can define an opening 502 between the netting hook 500 and the top plate 102. According to example aspects, the netting hook 500 can be configured to engage a safety netting (not shown) to support the safety netting above the floor of the building. For example, the safety netting can be a worker safety netting for protecting a worker in the event of a fall or can be a debris netting for capturing debris. In some aspects, the bottom plate 104 (shown in FIG. 1) can also comprise a netting hook 500 for engaging a safety netting.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. An indicator for a compression post comprising:

a leg defining a first end and a second end opposite the first end, the leg configured to engage a support plate of the compression post at the first end, wherein a slot is defined in the leg between the first end and the second end;

an indication portion supported by the leg at the second end, the indication portion comprising:

a first visual indicator configured to indicate that the compression post is in an uncompressed configuration; and a second visual indicator configured to indicate that the compression post is in a compressed configuration; and a fastener extending through the slot and slidable within the slot.

2. The indicator for a compression post of claim 1, further comprising a central portion extending between the leg and the indication portion.

3. The indicator for a compression post of claim 2, wherein the central portion extends from the leg at an angle relative thereto.

4. The indicator for a compression post of claim 1, wherein the second visual indicator is positioned between the first visual indicator and the leg.

5. The indicator for a compression post of claim 1, wherein the leg extends substantially parallel to the indication portion.

6. A compression post for a building comprising:

a post outer shell defining a hollow interior and comprising a first section and a second section spaced from the first section, the second section defining a window, wherein the first section is an upper section and the second section is a lower section, the upper section comprises an upper fastener ledge, the lower section comprises a lower fastener ledge, and a fastener engages the upper fastener ledge and lower fastener ledge;

an inner post slidably engaged with each of the first section and the second section of the post outer shell;

a visual indication system oriented within a hollow interior of the second section and comprising an indicator, the indicator visible through the window when the compression post is in a compressed configuration and an uncompressed configuration; and a spring, the spring biasing the compression post to the uncompressed configuration.

7. The compression post for a building of claim 6, wherein:

the indicator comprises an indication portion; and the indication portion comprises a first visual indicator indicative that the compression post is in the uncompressed configuration and a second visual indicator indicative that the compression post is in the compressed configuration.

8. The compression post of claim 7, wherein:

the first visual indicator can be viewed through the window in the uncompressed configuration; and the second visual indicator can be viewed through the window in the compressed configuration.

9. The compression post of claim 8, wherein:

a bolt extends through the second section of the outer post shell;

a slot is defined in the indicator; and the bolt slidably engages the slot to allow the second section to slide relative to the indicator.

10. The compression post of claim 6, wherein:

rotating the fastener moves the upper section relative to the lower section; and moving the lower section away from the upper section compresses the spring between the bolt and a bottom plate of the compression post.

11. The compression post of claim 6, wherein the upper fastener ledge and lower fastener ledge are oriented at an obtuse angle relative to the post outer shell and the fastener is oriented orthogonal to the upper fastener ledge and to the lower fastener ledge.

12. The compression post of claim 6, further comprising a top plate configured to engage a ceiling of the building and a bottom plate configured to engage a floor of the building.

13. The compression post of claim 6, wherein:

the visual indication system comprises a first visual indicator and a second visual indicator;

the first visual indicator is visible through the window in the uncompressed configuration; and the second visual indicator is visible through the window in the compressed configuration.

14. A method for using a compression post comprising:

providing a post outer shell and an inner post, the post outer shell comprising a first section and a second section, the inner post slidably engaged with at least the second section, wherein the compression post is in an uncompressed configuration;

showing a first visual indicator of a visual indication system in the uncompressed configuration;

moving the second section away from the first section to slide the second section along the inner post and to compress a spring and placing the compression post in a compressed configuration, wherein moving the second section away from the first section comprises rotating a fastener to push a distal end of the fastener against a fastener ledge of the first section; and revealing a second visual indicator of the visual indication system in the compressed configuration.

15. The method of claim 14, wherein compressing the spring comprises sliding a bolt within a slot of the visual indication system and applying a force on the spring with the bolt.

16. A compression post for a building comprising:

a post outer shell defining a hollow interior and comprising a first section and a second section spaced from the first section, the second section defining a window;

an inner post slidably engaged with each of the first section and the second section of the post outer shell;

a visual indication system oriented within a hollow interior of the second section and comprising an indicator, the indicator visible through the window when the compression post is in a compressed configuration and an uncompressed configuration, a slot defined in the indicator; and a bolt extending through the second section of the outer post shell, the bolt slidably engaging the slot to allow the second section to slide relative to the indicator;

wherein the indicator comprises an indication portion, and the indication portion comprises a first visual indicator indicative that the compression post is in the uncompressed configuration and a second visual indicator indicative that the compression post is in the compressed configuration;

wherein the first visual indicator can be viewed through the window in the uncompressed configuration, and the second visual indicator can be viewed through the window in the compressed configuration.

* * * * *